United States Patent [19]

Borgstrom et al.

[11] Patent Number: 4,863,392

[45] Date of Patent: Sep. 5, 1989

[54] HIGH-VOLTAGE LOADBREAK BUSHING INSERT CONNECTOR

[75] Inventors: Alan D. Borgstrom, Hackettstown; Frank M. Stepniak, Long Valley; Andrew A. Kominiak, Flanders, all of N.J.

[73] Assignee: Amerace Corporation, Parsippany, N.J.

[21] Appl. No.: 254,598

[22] Filed: Oct. 7, 1988

[51] Int. Cl.[4] ..... H01R 13/53

[52] U.S. Cl. ..... 439/185; 439/921

[58] Field of Search ..... 439/181–187, 439/921

[56] References Cited

U.S. PATENT DOCUMENTS

| | | | |
|---|---|---|---|
| 3,884,542 | 5/1975 | Flatt | 439/185 |
| 3,930,709 | 1/1976 | Stanger et al. | 439/607 |
| 3,957,332 | 5/1976 | Lambert, III | 439/183 |
| 4,186,985 | 2/1980 | Stepniak et al. | 439/607 |
| 4,773,872 | 9/1988 | Borgstrom et al. | 439/187 |

FOREIGN PATENT DOCUMENTS

| | | | |
|---|---|---|---|
| 2304197 | 10/1976 | France | 439/184 |

*Primary Examiner*—Gary F. Paumen

*Attorney, Agent, or Firm*—David Teschner

[57] ABSTRACT

A simplified electrical high voltage loadbreak bushing insert connector is disclosed which provides an improved electrical current path between a bushing well and a male probe contact during fault and activated closure while eliminating the usual prior art internal conductive sleeve contact. A solid contact, directly coupled to a bushing well stud, electrically engages a tubular extension of the movable female contact assembly during movement of the assembly over its entire range. In a first group of embodiments, contact is made with the interior of the tubular extension while in others with the exterior. Various stop member arrangements are disclosed to limit movement of the female contact assembly and of joining the solid contact to the insert body.

21 Claims, 8 Drawing Sheets

HIGH-VOLTAGE LOADBREAK BUSHING INSERT CONNECTOR

BACKGROUND OF THE INVENTION

1. Field of the Invention:

The invention relates to high-voltage separable connectors and more particularly to loadbreak bushing inserts with piston-operated movable female contact assemblies propelled by the production of arc-quenching gases within such inserts during fault closure and activated operations.

2. Description of the Prior Art:

High-voltage separable connectors are intended to interconnect sources of energy such as transformers to distribution networks or the like. A typical arrangement includes a bushing well connected to the transformer, a bushing insert which contains a female contact assembly connected to the well and an elbow connected to a distribution line and containing the male contact to join the insert female contact. Because closure of the male and female contacts can occur under activated conditions or under fault conditions, the female contact is arranged to move within the insert to hasten the closure of the male and female contacts and thus extinguish any arc created. However, it is necessary to maintain electrical continuity during the travel of the female contact assembly. The connection between such female contact assembly and the remainder of the bushing insert must be flexible so as not to impede its movement but sufficient to carry the high currents in the circuit. Mechanisms for achieving these results have not always provided sufficient current paths causing the connectors to run hot, and interfering with proper operation of the distribution network and in the extreme leading to the destruction of the bushing inserts.

In U.S. Pat. No. 3,982,812, issued Sept. 28, 1976 to General Electric Company, there appears a bushing insert or module 1 which contains a metal cylinder 8 in which movable female contact 4 moves from a rest position to engage an inserted metal contact rod 10. Contact between the female contact 4 and the cylinder 8 during movement is maintained by flexible coiled conductor 5. Because of the need for flexibility and the space constraints inside the bushing insert or module 1, the size of the conductor is not optimum for current transfer under activated or fault closure conditions.

In U.S. Pat. No. 4,186,985 issued Feb. 5, 1980, FIGS. 1 and 2 of which appear as FIGS. 1 and 2 herein, and U.S. Pat. No. 3,930,709 issued Jan. 6 1976, FIG. 4 of which appears herein as FIG. 3, both patents being assigned to the assignee of the instant Application, there is shown a louvered contact ring or spring 34, 52. As is shown in FIG. 1, metallic sleeve 12 is electrically coupled to female contact assembly 30 by means of louvered spring 34 which encircles and is movable with piston 32 of the assembly 30. FIG. 3 shows that actual contact is achieved by the ends of the spring fingers **52*b* and 52*c* which respectively contact metallic sleeve 38 and the piston 50**.

The quality and resistance of such contact is dependent upon the number of finger ends in contact and the amount of surface in contact. Distortion of the fingers, the presence of dirt or contaminants all decrease the amount of available contact area and influence the current density. Further, as the female contact assembly moves, the amount and quality of these contacts varies considerably.

This problem was treated and a substantial improvement made in the current transfer while the female contact assembly was in its initial position and in the initial stages of movement by providing a second contact operative at these times only to handle in a parallel path much of the high current present. However, once the female contact assembly was beyond its initial position, current transfer was again handled solely by the louvered contact ring or spring 34, 52 described above. This improved configuration is described and claimed in U.S. Pat. No. 4,773,872 issued Sept. 27, 1988, entitled "A Static Contact Member For A High-Voltage Bushing Insert" by Alan D. Borgstrom and assigned to the assignee of the instant application. FIG. 5 of that patent appears herein as FIG. 4.

SUMMARY OF THE INVENTION

The instant invention overcomes the difficulties noted above with respect to the prior art devices mentioned by providing a direct solid contact between the bushing well and the movable female contact assembly over its entire path of movement during activated and fault closures. The direct contact replaces the prior art louvered contact and eliminates the additional metallic sleeve required in such designs. It also facilitates a simpler design which permits, for example, the use of an all-plastic sleeve which includes the nose piece as a single molded unit, molded of a conductive plastic or coated with a conductive material, reducing the presence of trapped air and the potential for corona discharge.

The direct solid contact is coupled to a bushing well on one end and on the other is arranged to electrically engage a tubular extension of the movable female contact assembly during movement of the assembly over its entire range. In a first group of embodiments, the second end of the direct contact is segmented and enlarged to provide direct contact with the interior of the tubular extension. The contacting portion also provides a stop surface acted upon by a retaining ring, lanced fingers or stop rings on the tubular extension to limit forward movement of the female contact assembly. A second form of device makes use of the engagement of the free end of the tubular extension with the exterior of the direct contact for the required electrical path. Suitable rings on both parts engage to limit the travel of the female contact assembly. It is an object of this invention to provide a solid, direct contact with the movable female contact assembly within a high-voltage bushing insert.

It is an object of this invention to provide a simplified direct electrical contact between a bushing well and a movable female contact assembly in a bushing insert.

It is another object of this invention to provide a simplified direct electrical contact between a bushing well and a movable female contact assembly in a bushing insert over its entire range of travel in response to an activated or fault closure.

It is an object of this invention to simplify the design of a bushing insert by eliminating the usual louvered contact and metallic sleeve and replacing it with a direct, slideable contact between a bushing well the movable female contact assembly of a high-voltage bushing insert.

Other objects and features of the invention will be pointed out in the following description and claims and illustrated in the accompanying drawings, which disclose, by way of example, the principles of the invention, and the best modes which have been contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
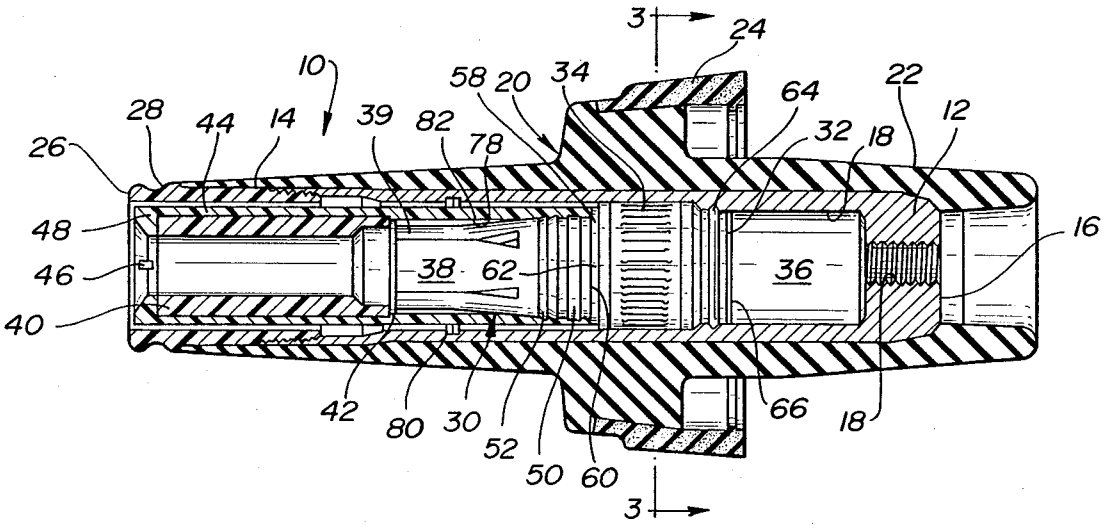
FIG-1 PRIOR ART
FIGS. 1 and 2 are side elevations, in section, of a prior-art bushing insert and are FIGS. 1 and 2 of U.S. Pat. No. 4,186,985 issued Feb. 5, 1980.
Figure 2:
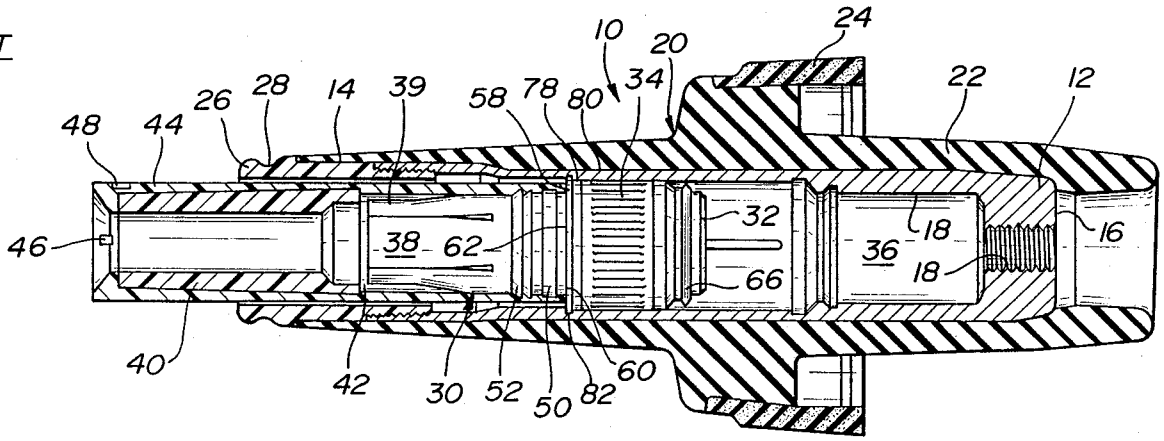
FIG-2 PRIOR ART
Figure 3:
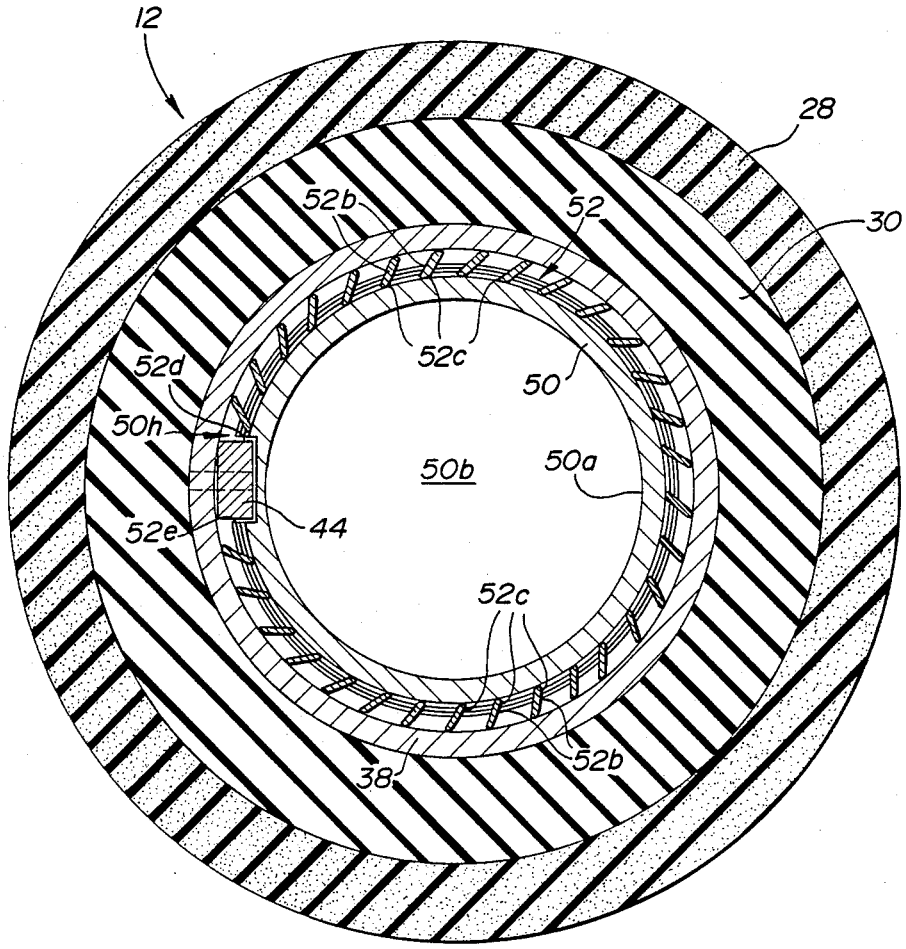
FIG-3 PRIOR ART
FIG. 3 is a front elevation, in section, of the bushing insert of FIG. 1 taken along the line 3—3 therein and is FIG. 4 of U.S. Pat. No. 3,930,709 issued Jan. 6 1976.
Figure 4:
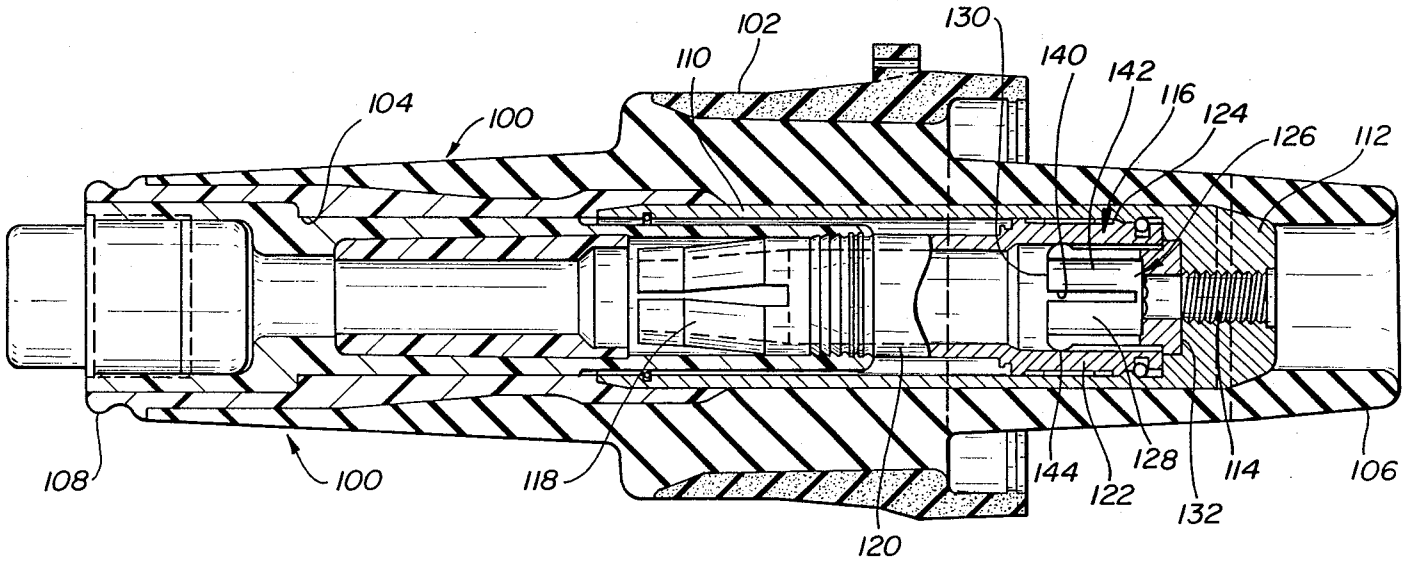
FIG-4 PRIOR ART
FIG. 4 is a side elevation, in section, of a prior-art bushing insert and is FIG. 5 of U.S. Pat. No. 4,773,872 issued Sept. 27, 1988.
Figure 5:
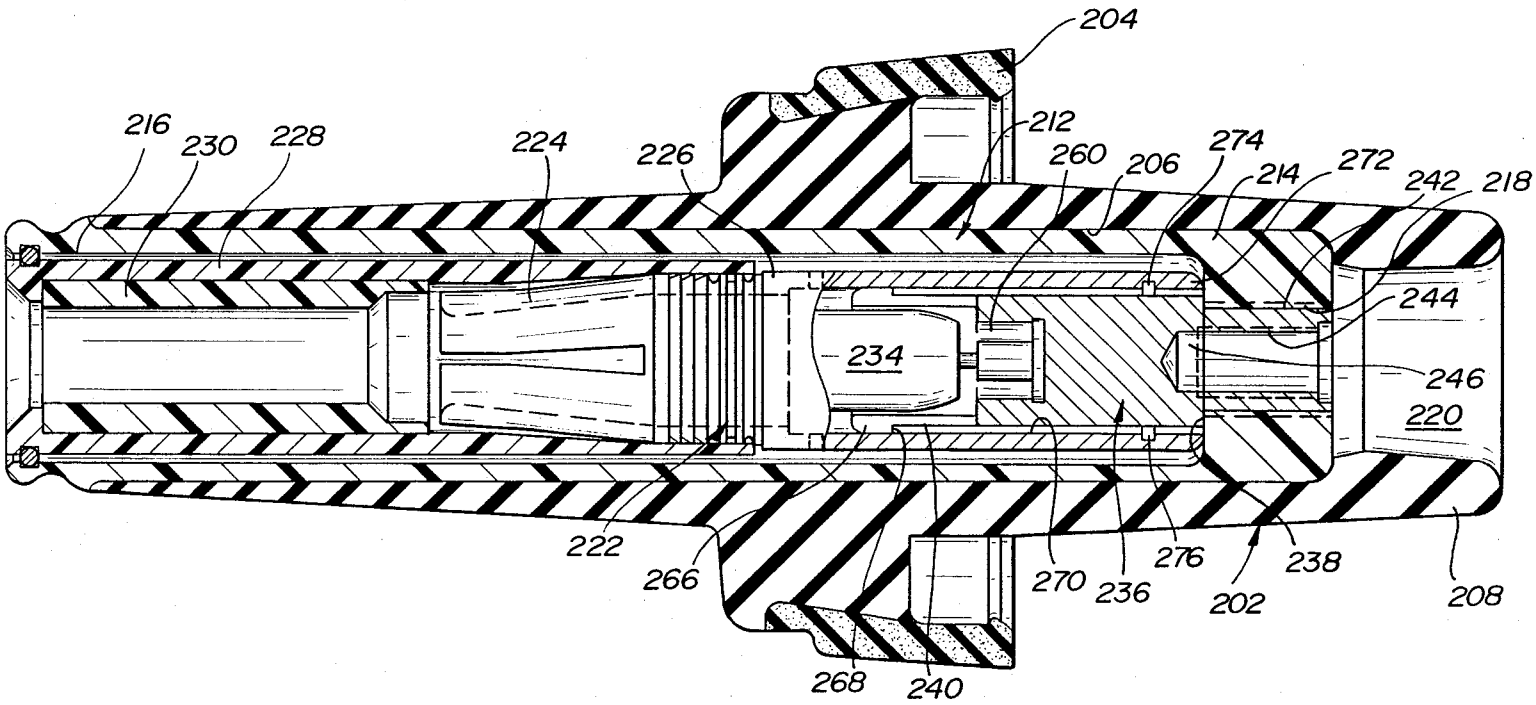
FIG. 5 is a side elevation, in section, of a bushing insert constructed in accordance with the concepts of the invention.
Figure 6:
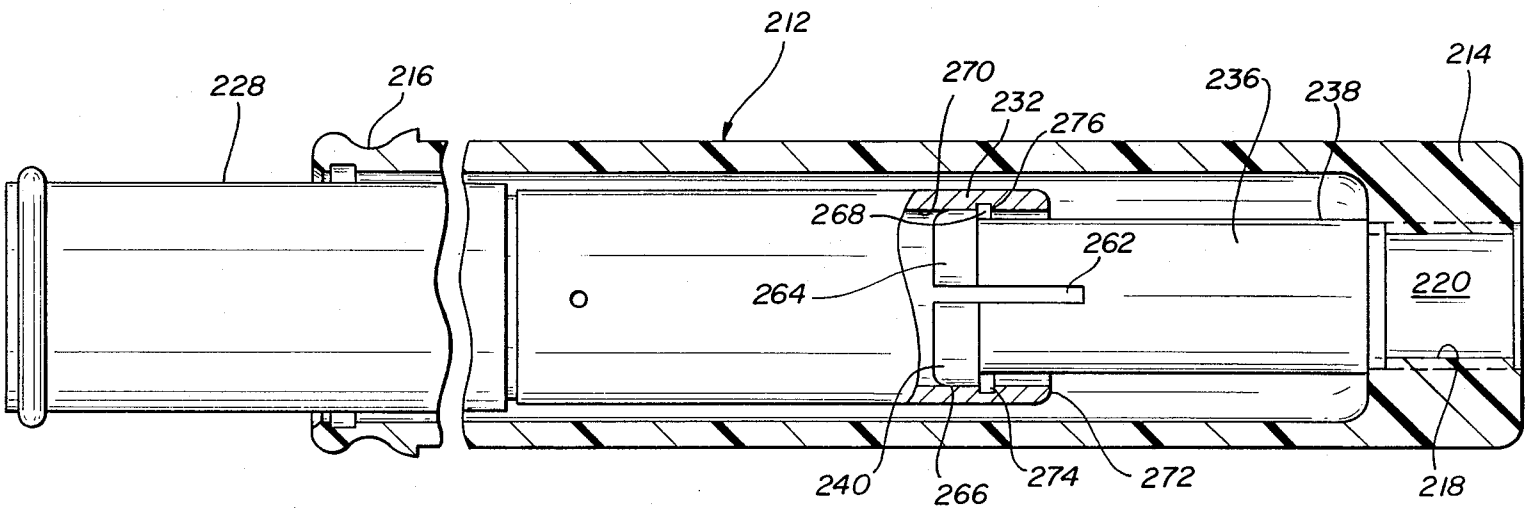
FIG. 6 is a side elevation, in section and foreshortened, showing a portion of the bushing insert of FIG. 5 in an operated state.

Turning now to FIGS. 5 and 6, there is shown a first embodiment of a bushing insert 200 constructed in accordance with the concepts of the invention. Bushing insert 200 is composed of an elongated body portion 202 fabricated from an insulating material such as rubber, synthetic rubber, plastic or the like and may be EDPM rubber. Placed about a portion of the exterior of body portion 202 is a semi-conductive layer 204 such as conductive EDPM rubber. A longitudinal bore 206 extends the entire length of the body portion 202 from a first end 208 to a second end 210. Fitted within bore 206, for its entire length is a non-metallic sleeve 212 having a substantially closed end 214 adjacent first end 208 of body portion 202 and an open end 216 formed as a nose-piece adjacent second end 210 of body portion 202. This unitary construction of non-metallic sleeve 212 eliminates the need for a separately molded nose-piece which must be joined to the body portion 202. Sleeve 212 is molded of conductive plastic or is coated with a conductive material such as paint or the like so that an equipotential level is maintained along its length. It eliminates an assembly operation and decreases air pockets which could lead to corona discharges.

A passage 218 through end 214 of sleeve 212 communicates with recess 220 which receives a portion of a bushing well (not shown).

Placed within non-metallic sleeve 212 for its entire length is a movable female contact assembly 222 consisting essentially of the female contacts 224, an operating piston 226, a plastic sleeve 228, an arc-quenching gasgenerating sleeve 230 and a hollow tubular metallic extension 232. As is well known in the art, upon the attempted closure of the male contact probe with the female contacts in a bushing insert when the circuit is activated or there is a ground fault, an arc is struck and continues until a solid electrical contact is made. To minimize the destructive effects of the arc, an arc-quenching gas is generated to snuff the arc as quickly as possible. Thus, as the male contact probe (not shown) approaches female contacts 224, an arc (not shown) is struck which passes along the surface of sleeve 230 causing the generation of arc-quenching gases which are directed toward end 208 of body portion 202 into chamber 234. When the pressure of the gases in chamber 234 is high enough, it acts upon piston 226 to move the entire female contact assembly 222 toward end 210 of body portion 202, as is shown in FIG. 6 to, firmly establish contact between the female contacts 224 and the male contact probe (not shown). The tubular extension 232 is similarly moved by movement as assembly 222.

Within tubular extension 232 of the movable female contact assembly is contact 236 which is substantially solid at a first end 238 adjacent substantially closed end 214 of non-metallic sleeve 212 and is tubular at a second end 240 adjacent piston 226 of female assembly 222.

Adjacent first end 238 is a tubular extension 242 of reduced exterior dimension and bored as at 244 to facilitate assembly of the contact 236 with sleeve 212 at the substantially closed end 214. The tubular extension 242 could be so dimensioned that it would be press-fit into passage 218 and its position held when the stud of the bushing well (not shown) is threaded through threaded bore 244 into a threaded bore extension 246 in the main portion of contact 236. Alternatively, the outer surface of tubular extension 242 could be threaded to engage the threaded interior surface of passage 218. Also, the plastic sleeve 212 could be joined to metallic contact 236 by sonic welding or heat expansion.

Figure 7:
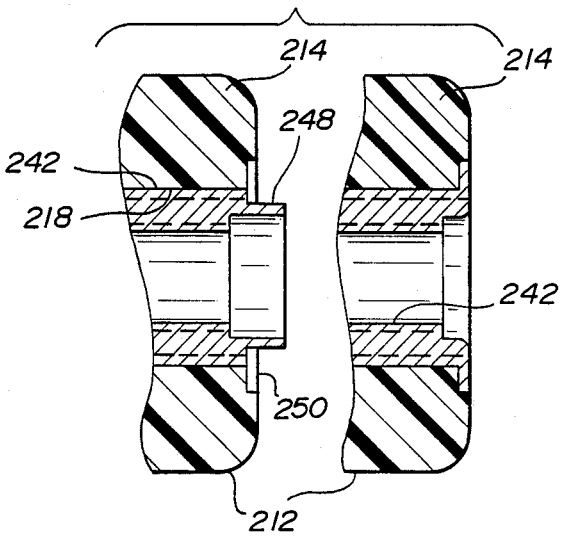
FIG. 7 is a fragmentary side elevation, in section, of an alternative method of joining the metallic contact to the non-metallic chamber or sleeve of FIG. 5.

Further, as shown in FIG. 7, the extension 242 can be formed with tabs 248 while the end surface of sleeve 212 is provided with a recess 250 about the passage 218 to receive the folded over or up-set tabs 248.

Figure 8:
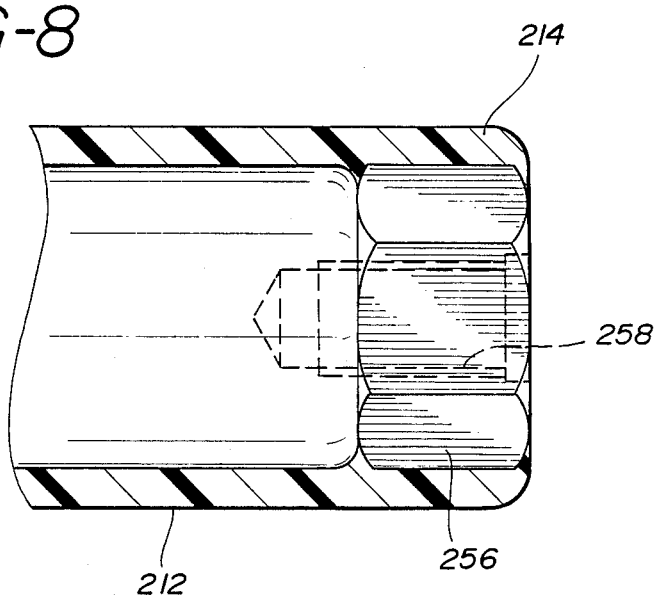
FIGS. 8 and 9 are fragmentary side elevations, in section, of methods of reinforcing the non-metallic chamber or sleeve of FIG. 5.
Figure 9:
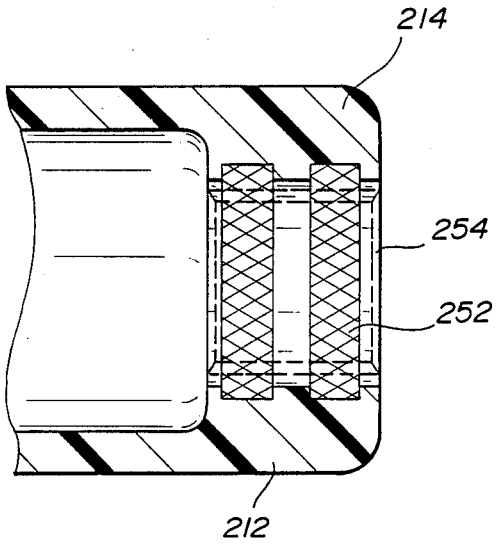

To strengthen and reinforce the non-metallic sleeve 212, a metal insert 252 with a bore 254 therethrough may be molded into sleeve 212 or force-fit therein after molding as in FIG. 9. Likewise, a suitable nut 256 with threaded passage 258 therethrough may be positioned adjacent passage 218 in the substantially closed end 214 of sleeve 212 as is shown in FIG. 8.

End 240 of contact 236, as stated above is generally tubular so that it can receive the end of the male contact probe which is engaged by a socket 260. Tubular end 240 is slotted as at 262 to provide a series of spring fingers 264. An annular ring 266 can be placed about the outer surface of contact 236 adjacent end 240 to further increase the contact surface of the fingers 264. Ring 266 is similarly slotted. Additionally, a ring spring 269 (FIG. 12) can be placed within contact 236 adjacent end 240 to deflect fingers 264 outwardly to increase the contact with the inner surface 270 of the tubular extension 232. The rear face 268 acts as a stop surface as will be described below. The outer surface of ring 266 supported by spring fingers 264 makes solid electrical contact within inner surface 270 of the tubular extension 232 over the entire range of movement of the movable female contact assembly 222 and with the bushing well into which the bushing insert 200 is assembled. While the discussion thus far has been in terms of a bushing well with stud and a bushing insert with threaded receptacle, the two could be reversed so as to provide the bushing insert with the stud while the bushing well is provided with a threaded receptacle.

Figure 10:
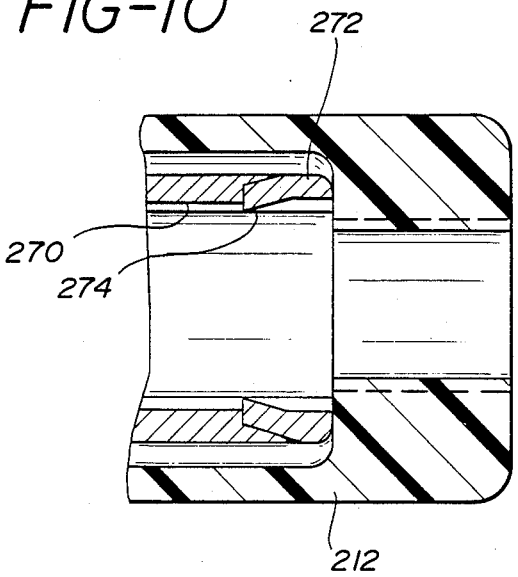
FIG. 10 is a fragmentary side elevation, in section, of an alternative form of female contact assembly stop mechanism.
Figure 11:
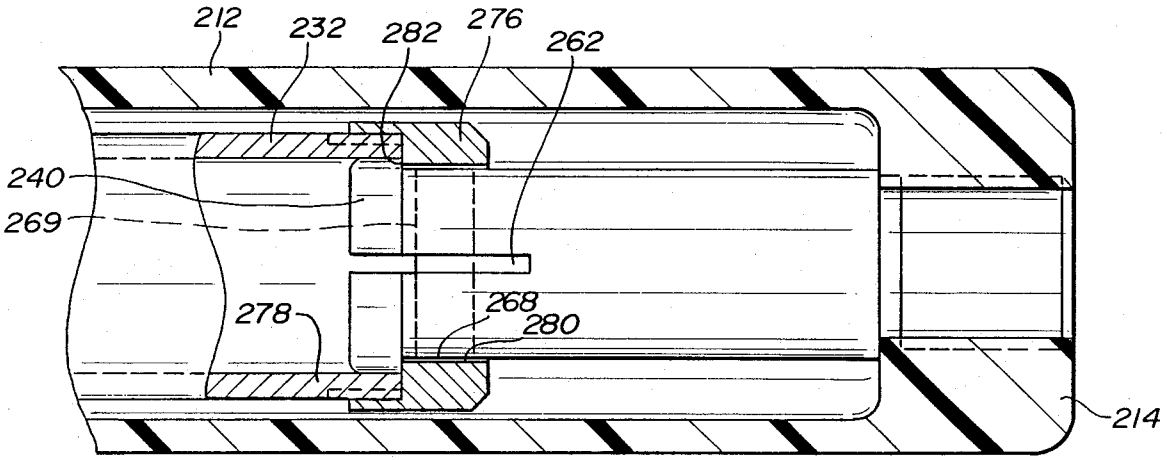
FIG. 11 is a fragmentary side elevation, in section, of another alternative form of female contact assembly stop mechanism.

Adjacent end 272 of tubular extension 232 on the inner surface 270 is an annular recess 274 into which is placed a retention ring 276. Retention ring 276 is arranged to engage stop surface 268 of ring 266 as is shown in FIG. 6 and thus limit the movement of the female contact assembly 222 in the direction of end 210 of body portion 202. A further stop arrangement, as is shown in FIG. 10, involves lancing the end 272 of extension 232 to form inwardly directed tabs 274 which can engage stop surface 268 to limit movement of assembly 222 toward end 210 of body portion 202. Further, a stop ring 276 could be added at the end 272 of extension tube 232. Stop ring 276 would be made to threadably engage extension 232 as at 278 while providing an interior annular ring 280 whose leading face 282 would act as a further stop surface to engage stop surface 268 and limit movement of assembly 222 as shown in FIG. 11.

Figure 12:
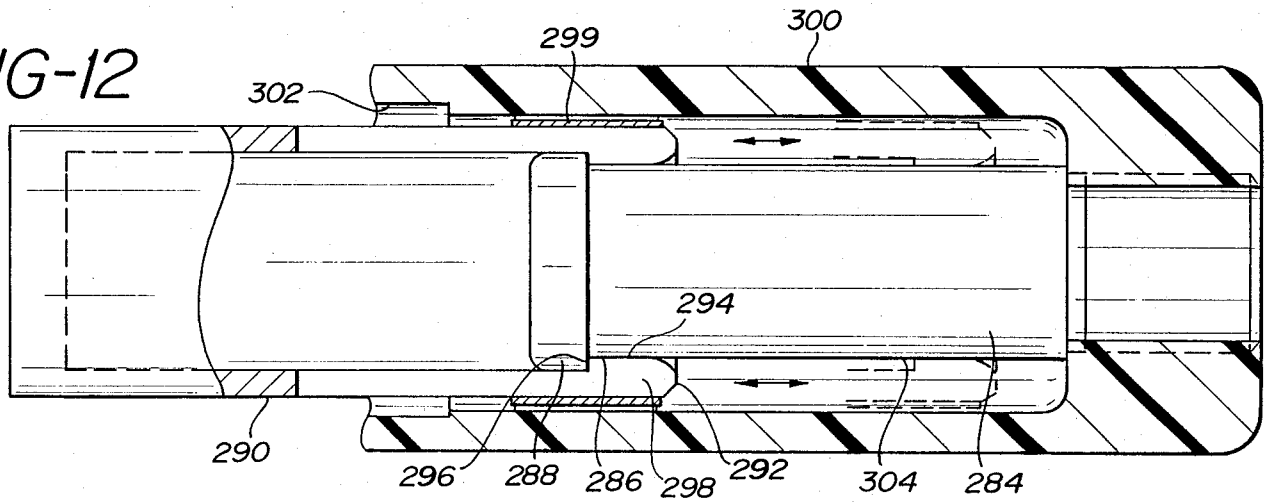
FIG. 12 is a fragmentary side elevation, in section, of still another alternative metallic contact for engaging the moving female contact assembly.

As an alternative to contact between contact 236 and the interior surface 270 of extension 232, FIG. 12 shows an arrangement by which contact is made between an end of the extension 232 and the exterior surface of the contact 236 without the use of spring fingers such as 240. Contact 284 has a stop ring 288 about end 286 of contact 284 but contact end 286 and ring 288 are not slotted to provide spring-finger contact surfaces. End 292 of extension 290 is provided with an interior annular ring 294 whose leading face 296 acts as a stop surface. End 292 and ring 294 are slotted to provide a plurality of distinct spring fingers 298. Body portion 300 is recessed as 302 to permit the fingers 298 to be flexed outwardly, permitting ring 294 to pass over ring 288 during assembly. A plurality of spring pads 299 bear upon the fingers 298 to insure good electrical contact between the fingers 298 and the outer surface 304 of contact 285. The movement of the female contact assembly 222 will be limited by engagement between stop surface 296 and stop ring 288 while a current path is maintained between the bushing well (not shown) and the male contact probe (not shown) via contact 284 and spring fingers 298 of extension 290.

Although the discussion of the instant invention has been in terms of a loadbreak bushing insert, the novel direct electrical contact can be used on any loadbreak device such as integral bushings, feed-through bushings, feed-through inserts, junctions, etc.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined as follows:

We claim:

1. In a high-voltage load-break bushing insert of the type having an elongate, insulative body member with a central bore extending from a first end to a second end;

a generally hollow, cylindrical non-metallic sleeve within a portion of said body member, said non-metallic sleeve having an apertured end adjacent said first end of said body member;

a movable female contact assembly positioned within and spaced from the hollow portion of said non-metallic sleeve for non-engaging movement therein from a first position adjacent said first end of said body member to a second position closer to said second end of said body member; said movable female contact assembly having a hollow tubular metallic sleeve portion having a first end coupled to a female contact and a second free end remote from said female contact;

a static metallic contact means positioned within said non-metallic sleeve, said contact means having a first portion adjacent said apertured end and having means to couple said metallic contact means to the conductive stud of a high voltage bushing well;

said contact means having a second portion remote from said first portion of said contact means; and contact members coupled to said metallic contact means and said metallic sleeve portion for maintaining a continuous electrical path therebetween during the entire movement of said female contact assembly from said first position to said second position.

2. A bushing insert as defined in claim 1, further including coupling means for joining said first portion of said static metallic contact means to said cylindrical non-metallic sleeve at its substantially closed end.

3. A bushing insert as defined in claim 2, wherein said coupling means is a threaded union.

4. A bushing insert as defined in claim 2, wherein said coupling means is a press fit.

5. A bushing insert as defined in claim 2, wherein said coupling means is an up-set end of said first portion of said static metallic contact means into an accommodating exterior recess in said non-metallic sleeve exterior surface.

6. A bushing insert as defined in claim 2, wherein said coupling means is sonic welding.

7. A bushing insert as defined in claim 2, wherein said coupling means involves heat expansion.

8. A bushing insert as defined in claim 1, further including reinforcement means in said apertured end of said non-metallic sleeve.

9. A bushing insert as defined in claim 8, wherein said reinforcement means is a hollow collar having a knurled exterior surface to be embedded in the apertured end of said non-metallic sleeve.

10. A bushing insert as defined in claim 8, wherein said reinforcement means is a nut having a plurality of wrench flats embedded in the apertured end of said non-metallic sleeve.

11. A bushing insert as defined in claim 1, wherein said second portion of said contact means is generally circular and arranged to fully engage the interior surface of said hollow tubular metallic sleeve portion of said female contact assembly.

12. A bushing insert as defined in claim 1, wherein said second portion of said contact means is generally circular and is segmented so as to provide a series of spring fingers arranged to engage the interior surface of said hollow tubular metallic sleeve portion of said female contact assembly.

13. A bushing insert defined in claim 1, wherein said second portion of said contact means is generally circular and further has an annular ring about its free end;

said contact means second portion and said annular ring are segmented so as to provide a series of spring fingers arranged to engage the interior surface of said hollow tubular metallic sleeve portion of said female contact assembly.

14. A bushing insert as defined in claim 13, wherein said annular ring further provides a stop surface;

said insert further including a retention ring mounted on the interior surface of said hollow tubular metallic sleeve portion of said female contact assembly adjacent said free end, the engagement of said retention ring with said stop surface limiting the further travel of said female contact assembly.

15. A bushing insert as defined in claim 13, wherein said annular ring further provides a stop surface;

said insert further including a plurality of lanced portions in said hollow tubular metallic sleeve portion of said female contact assembly adjacent said free end, the free ends of the lanced portions extending inwardly into the interior of said tubular metallic sleeve portion, the engagement of the free ends of said lanced portions with said stop surface limiting the further travel of said female contact assembly.

16. A bushing insert as defined in claim 13, wherein said annular ring further provides a first stop surface;

said insert further including a stop ring coupled to the free end of said hollow tubular metallic sleeve portion of said female contact assembly;

said stop ring having a second stop surface, the engagement of said second stop surface of said stop ring with said first stop surface of said annular ring limiting the further travel of said female contact assembly.

17. A bushing insert as defined in claim 1, wherein said free end of said hollow tubular metallic sleeve portion of said female contact assembly is generally circular and arranged to fully engage the exterior surface of the static metallic contact means.

18. A bushing insert as defined in claim 1, wherein said free end of said hollow tubular metallic sleeve portion of said female contact assembly is generally circular and is segmented so as to provide a series of spring fingers arranged to fully engage the exterior surface of said static metallic contact means.

19. A bushing insert as defined in claim 1, wherein said free end of said hollow tubular metallic sleeve portion of said female contact assembly is generally circular and further has an annular ring at its free end on the interior surface thereof, said free end and said annular ring being segmented so as to provide a series of spring fingers arranged to fully engage the exterior surface of said static metallic contact means.

20. A bushing insert as defined in claim 19, further including a plurality of sleeve springs, one for each said spring finger, each said sleeve spring being mounted upon a said spring finger to engage the interior surface of said non-metallic sleeve to increase the contact between said spring fingers and the exterior surface of said static metallic contact means.

21. A bushing insert as defined in claim 1, further comprising a first annular ring about the exterior of the end of said second portion of said static metallic contact means to provide a first stop surface;

a second annular ring at the free end of said hollow tubular metallic sleeve portion of said female contact assembly on the interior surface thereof, said second annular ring providing a second stop surface, the engagement of said second stop surface with said first stop surface limiting the further travel of said female contact assembly.

* * * * *